US008127923B2

(12) United States Patent
Gelmetti

(10) Patent No.: US 8,127,923 B2
(45) Date of Patent: Mar. 6, 2012

(54) CONTAINER FOR WELDING WIRE

(75) Inventor: Carlo Gelmetti, Lazise (IT)

(73) Assignee: Sidergas SPA (IT)

( * ) Notice: Subject to any disclaimer, the term of this patent is extended or adjusted under 35 U.S.C. 154(b) by 0 days.

(21) Appl. No.: 12/618,165

(22) Filed: Nov. 13, 2009

(65) Prior Publication Data

US 2011/0114523 A1 May 19, 2011

(51) Int. Cl.
*B65D 19/00* (2006.01)

(52) U.S. Cl. ..... 206/386; 206/409; 220/485; 242/160.4; 242/170

(58) Field of Classification Search ..... 206/409, 206/386, 202, 509, 303, 407, 408; 220/494, 220/485, 668, 743, 9.4, 9.1; 242/160.4, 170, 242/171

See application file for complete search history.

(56) References Cited

U.S. PATENT DOCUMENTS

| | | | | | |
|---|---|---|---|---|---|
| RE8,148 | E | * | 4/1878 | Meinikheim et al. | 220/485 |
| 1,468,994 | A | | 9/1923 | Cook | 206/393 |
| 1,640,368 | A | | 8/1927 | Obetz et al. | |
| 2,260,230 | A | * | 10/1941 | Olson | 229/119 |
| 2,319,628 | A | * | 5/1943 | Pinniger | 220/485 |
| 2,477,059 | A | | 7/1949 | Hill | 242/137.1 |
| 2,579,131 | A | | 12/1951 | Tinsley | 206/409 |
| 2,580,900 | A | | 1/1952 | Epstein | 206/409 |
| 2,713,938 | A | | 7/1955 | Snyder | 206/395 |
| 2,864,565 | A | | 12/1958 | Whearley | |
| 2,911,166 | A | | 11/1959 | Haugwitz | 242/128 |
| 2,984,596 | A | | 5/1961 | Franer | 206/412 |
| 3,028,066 | A | * | 4/1962 | Bumby | 220/23.9 |
| 3,096,951 | A | | 7/1963 | Jenson | 242/137.1 |
| 3,119,042 | A | | 1/1964 | Bond | |
| 3,244,347 | A | | 4/1966 | Jenk | |
| 3,352,412 | A | | 11/1967 | Draving et al. | 242/170 |
| 3,491,876 | A | | 1/1970 | Zecchin | 206/395 |
| 3,648,920 | A | | 3/1972 | Stump | 229/199 |

(Continued)

FOREIGN PATENT DOCUMENTS

DE 103 60 466 7/2005

(Continued)

OTHER PUBLICATIONS

Search Report received in Applicant's counterpart European Patent Application Serial No. 08017572.2-2302.

(Continued)

*Primary Examiner* — David Fidei
(74) *Attorney, Agent, or Firm* — Hayes Soloway P.C.

(57) ABSTRACT

A container for accommodating a welding wire coil has a metal frame which defines an accommodation space for the welding wire coil. The metal frame has a bottom portion on which the welding wire coil is to be placed, and a side structure intended to laterally support the welding wire coil. The bottom portion of the metal frame is formed from four metal bars arranged so as to form a grid, and the side structure of the metal frame is formed by eight metal tubes, each of which is connected to one of the ends of the metal bars. The container further has a cardboard wall structure covering the outside of the side structure of the metal frame and having an octagonal shape in cross-section, and a cardboard floor structure covering the outside of the bottom portion of the metal frame. Furthermore, supporting feet are provided which are bolted to the metal frame and which clamp the cardboard floor structure to the bottom portion of the metal frame.

18 Claims, 7 Drawing Sheets

U.S. PATENT DOCUMENTS

| | | | | |
|---|---|---|---|---|
| 3,823,894 | A | 7/1974 | Frederick et al. | 242/137.1 |
| 3,939,978 | A | 2/1976 | Thomaswick | 206/454 |
| 3,958,712 | A * | 5/1976 | Martin | 217/40 |
| 4,097,004 | A | 6/1978 | Reese | 242/129 |
| 4,161,248 | A | 7/1979 | Kalmanovitch | 206/389 |
| 4,274,607 | A | 6/1981 | Priest | 242/163 |
| 4,392,606 | A | 7/1983 | Fremion | 206/600 |
| 4,451,014 | A | 5/1984 | Kitt et al. | 242/128 |
| 4,516,692 | A * | 5/1985 | Croley | 222/105 |
| 4,582,198 | A | 4/1986 | Ditton | |
| 4,795,057 | A * | 1/1989 | Jungels et al. | 206/386 |
| 4,869,367 | A | 9/1989 | Kawasaki et al. | 206/409 |
| 4,974,789 | A | 12/1990 | Milburn | 242/159 |
| 5,105,943 | A | 4/1992 | Lesko et al. | |
| 5,109,983 | A | 5/1992 | Malone et al. | 206/408 |
| 5,201,419 | A | 4/1993 | Hayes | 206/409 |
| 5,277,314 | A | 1/1994 | Cooper et al. | 206/398 |
| 5,279,441 | A * | 1/1994 | Featherall | 220/485 |
| 5,368,245 | A | 11/1994 | Fore | 242/171 |
| 5,485,968 | A | 1/1996 | Fujioka | 242/172 |
| 5,494,160 | A | 2/1996 | Gelmetti | |
| 5,553,810 | A | 9/1996 | Bobeczko | 206/409 |
| 5,645,185 | A * | 7/1997 | Cassina | 220/1.5 |
| 5,702,001 | A * | 12/1997 | Russell et al. | 206/388 |
| 5,738,209 | A | 4/1998 | Burr et al. | 206/397 |
| 5,746,380 | A * | 5/1998 | Chung | 242/171 |
| 5,819,934 | A | 10/1998 | Cooper | |
| 5,845,862 | A | 12/1998 | Cipriani | 242/423.1 |
| 5,921,391 | A | 7/1999 | Ortiz et al. | 206/397 |
| 5,988,370 | A | 11/1999 | Roemer et al. | 206/215 |
| 6,016,911 | A | 1/2000 | Chen | 200/395 |
| 6,019,303 | A | 2/2000 | Cooper | |
| 6,237,768 | B1 * | 5/2001 | Cipriani | 206/408 |
| 6,260,781 | B1 | 7/2001 | Cooper | |
| 6,464,077 | B1 | 10/2002 | Liu | 206/388 |
| 6,547,176 | B1 | 4/2003 | Blain et al. | 242/423.1 |
| 6,564,943 | B2 | 5/2003 | Barton et al. | 206/395 |
| 6,636,776 | B1 | 10/2003 | Barton et al. | |
| 6,648,141 | B2 | 11/2003 | Land | 206/408 |
| 6,649,870 | B1 | 11/2003 | Barton et al. | |
| 6,715,608 | B1 | 4/2004 | Moore | 206/397 |
| 6,745,899 | B1 | 6/2004 | Barton | |
| 6,749,136 | B1 | 6/2004 | Speck | |
| 6,889,835 | B2 | 5/2005 | Land | 206/408 |
| 6,913,145 | B2 | 7/2005 | Barton | 206/409 |
| 6,938,767 | B2 * | 9/2005 | Gelmetti | 206/408 |
| 6,977,357 | B2 | 12/2005 | Hsu et al. | |
| 7,004,318 | B2 | 2/2006 | Barton | 206/409 |
| 7,147,176 | B2 | 12/2006 | Rexhaj | |
| 7,152,735 | B2 | 12/2006 | Dragoo et al. | 206/408 |
| 7,156,334 | B1 | 1/2007 | Fore et al. | 242/171 |
| 7,178,755 | B2 | 2/2007 | Hsu et al. | |
| 7,198,152 | B2 | 4/2007 | Barton et al. | |
| 7,309,038 | B2 | 12/2007 | Carroscia | 206/409 |
| 7,377,388 | B2 | 5/2008 | Hsu et al. | 206/389 |
| 7,410,111 | B2 | 8/2008 | Corroscia | |
| 7,441,657 | B2 | 10/2008 | Gelmetti | 206/393 |
| 7,441,721 | B2 | 10/2008 | Bae et al. | 242/128 |
| 2002/0000391 | A1 | 1/2002 | Kawasai et al. | 206/408 |
| 2003/0006235 | A1 * | 1/2003 | Przytulla | 220/485 |
| 2003/0042162 | A1 | 3/2003 | Land | 206/408 |
| 2003/0042163 | A1 | 3/2003 | Cipriani | |
| 2003/0052030 | A1 * | 3/2003 | Gelmetti | 206/397 |
| 2004/0155090 | A1 | 8/2004 | Jensen | 206/408 |
| 2006/0027699 | A1 | 2/2006 | Bae et al. | |
| 2006/0278747 | A1 | 12/2006 | Carroscia | |
| 2007/0175786 | A1 | 8/2007 | Nicklas | |
| 2007/0272573 | A1 | 11/2007 | Gelmetti | |
| 2008/0156925 | A1 | 7/2008 | Cooper | 242/559.3 |
| 2009/0014572 | A1 | 1/2009 | Weissbrod et al. | |
| 2009/0014579 | A1 | 1/2009 | Bender et al. | |

FOREIGN PATENT DOCUMENTS

| | | |
|---|---|---|
| EP | 2 267 255 | 4/1974 |
| EP | 0408259 | 4/1992 |
| EP | 2 264 482 | 9/1993 |
| EP | 584056 | 2/1994 |
| EP | 0665 166 | 1/1995 |
| EP | 1 057 751 | 12/2000 |
| EP | 1 275 595 | 1/2003 |
| EP | 1 295 813 | 3/2003 |
| EP | 1 471 024 | 10/2004 |
| EP | 1 698 421 | 6/2006 |
| EP | 2 256 064 | 1/2010 |
| EP | 2 168 706 | 3/2010 |
| EP | 2 286 950 | 2/2011 |
| GB | 2 332 451 | 6/1999 |
| JP | 54-035842 | 3/1979 |
| JP | 55-054295 | 4/1980 |
| JP | 60-082275 | 5/1985 |
| JP | 60-082276 | 5/1985 |
| JP | 1-65265 | 4/1989 |
| JP | 3 -264169 | 11/1991 |
| JP | 4-112169 | 1/1992 |
| JP | 5-178538 | 7/1993 |
| JP | 7-247058 | 9/1995 |
| JP | 8-40642 | 2/1996 |
| JP | 2000-202630 | 7/2000 |
| JP | 2000-225468 | 8/2000 |
| JP | 2001-26375 | 1/2001 |
| JP | KR 2002-0077857 | 10/2002 |
| JP | 2005-169499 | 6/2005 |
| JP | 2007-927 | 1/2007 |
| JP | 2007-29971 | 2/2007 |
| WO | WO 81/03319 | 11/1981 |
| WO | WO 88/10230 | 12/1988 |
| WO | WO 94/19258 | 9/1994 |
| WO | WO 98/52844 | 11/1998 |
| WO | WO 02/094493 | 11/2002 |
| WO | WO 03/106096 | 12/2003 |
| WO | WO 2005/061168 | 7/2005 |
| WO | WO 2007/112972 | 10/2007 |
| WO | WO 2007/149689 | 12/2007 |
| WO | WO 2009/007845 | 1/2009 |

OTHER PUBLICATIONS

Search Report received in Applicant's counterpart European Patent Application Serial No. 10014216.5-256 (8 pages), dated Apr. 14, 2011.

Search Report received in Applicant's counterpart European Patent Application Serial No. 11000892.7-2302 (8 pages), dated Jul. 19, 2011.

Search Report received in Applicant's counterpart European Patent Application Serial No. 11000236.7 (8 pages), dated Aug. 4, 2011.

* cited by examiner

CONTAINER FOR WELDING WIRE

FIELD OF THE INVENTION

The invention relates to a container for accommodating an amount of welding wire.

BACKGROUND OF THE INVENTION

For applications requiring a large amount of welding wire, it is known to provide the welding wire in the form of a coil which is placed in a container. The container has a floor on which the welding wire coil is placed, and side walls which laterally support the welding wire coil. On top of the container, a cover is arranged. The welding wire can be withdrawn from the container by simply pulling it through a hole in the cover or an opening provided in a separate dome which is placed on the container for removing the welding wire. In many cases, the container as such is formed from cardboard, and it is placed on a wooden pallet in order to allow transportation and handling. Even though welding wire containers from cardboard have proven to be reliable, there are efforts to increase the stability of the container. To this end, corner reinforcements are now state-of-the-art. Nevertheless, there still exists a need for even stronger containers.

SUMMARY OF THE INVENTION

The invention provides a container which is distinguished by superior stability. The container according to the invention has a metal cage with a floor portion and a side portion extending from the floor portion. Further, it has a cardboard wall associated to the side portion of the metal cage. This container is based on the idea of assigning the different objects of the container to different elements. The metal cage is provided for achieving the mechanical stability which is required for receiving the welding wire coil and holding it during transportation and handling. The cardboard wall is provided for protecting the welding wire coil against contamination and dirt. Using different elements for the different tasks allows to have a container which can be manufactured quickly and without significant costs.

Preferably, the components of the metal cage are simply welded to each other. The floor portion can consist of four flat metal bars which are arranged pairwise perpendicularly with respect to each other, and the side portion of the metal cage can consist of eight metal tubes which are welded to the ends of the four metal bars. Thereby, the cage can be formed very quickly.

In order to increase the stability, a reinforcement ring can be provided at an end of the side portion which is opposite the floor portion. The reinforcement ring preferably is made from a metal strip which is welded to the tubes.

The cardboard wall is preferably formed in a single piece which extends around the side portion of the metal cage. This allows to simply slip the cardboard wall over the metal cage during assembly.

In order to also close the floor of the container, a cardboard floor is associated to the floor portion of the metal cage. The cardboard floor can be connected to the floor portion of the metal cage by means of supporting feet which are arranged underneath the container and which clamp the cardboard floor to the metal cage.

The supporting feet can be attached by means of bolts which extend from the interior of the container, and nuts which are accessible at an outer surface of the supporting feet.

This allows to mount the supporting feet at the container in a simple manner, and also to detach the feet therefrom.

The supporting feet can be made from wood. Preferably, they are arranged at the container such that a forklift can be used for handling the container.

Preferably, a dome is provided which is arranged at the end of the side portion of the metal cage which is opposite the floor portion. The dome can be used for guiding the welding wire when it is withdrawn from the container.

Preferably, the dome is detachably connected to the metal frame. In particular, the dome can have a couple of legs which are inserted into the metal tubes forming the side portion of the metal cage. If necessary, locking pins can be used.

According to a preferred embodiment, a protective plastic bag is arranged between the side portion of the metal cage and the cardboard wall. The plastic bag prevents moisture from entering into the interior of the container.

The container is in particular suited for accommodating a welding wire coil made from welding wire having a diameter of more than 2.00 mm, preferably of 4.00 to 6.00 mm. Welding wire with this diameter, which is particularly suitable for sub-arc welding, requires a particularly strong container. The metal cage of the container according to the invention provides the required strength due to the metal cage which is able to receive the forces exerted by the welding wire coil.

Preferably, the welding wire coil placed in the container has an initial starting portion, the diameter of which is reduced as compared to the diameter of the remainder of the welding wire of the welding wire coil. The starting portion with reduced diameter facilitates insertion of the welding wire into a liner guiding the welding wire from the welding wire coil towards a welding torch.

The starting portion can have a length of 0.5 to 4 m, depending on the particular application. In some cases, it is sufficient to have just a short starting portion which is followed by welding wire with its nominal diameter. For other applications, insertion of the welding wire is greatly facilitated if the starting portion can be completely fed into the welding system until it exits at the welding torch and can be pulled through the welding system. Once the welding wire with the nominal diameter arrives at the welding torch, the starting portion is cut off.

For welding wire used for sub-arc welding, it has been found out that a diameter of approximately 2.00 mm for the starting portion provides very good performance.

BRIEF DESCRIPTION OF THE DRAWINGS

The invention will now be described with reference to the enclosed drawings. In the drawings, FIG. 1 schematically shows a container in a side view, FIG. 2 schematically shows the metal cage in a top view with a welding wire coil placed therein.

DETAILED DESCRIPTION OF THE DRAWINGS

A container for accommodating a welding wire coil is shown in FIGS. 1 to 4. Basically, the container consists of three elements: A metal cage 10, a cardboard cover 20 and feet 30.

Figure 2:
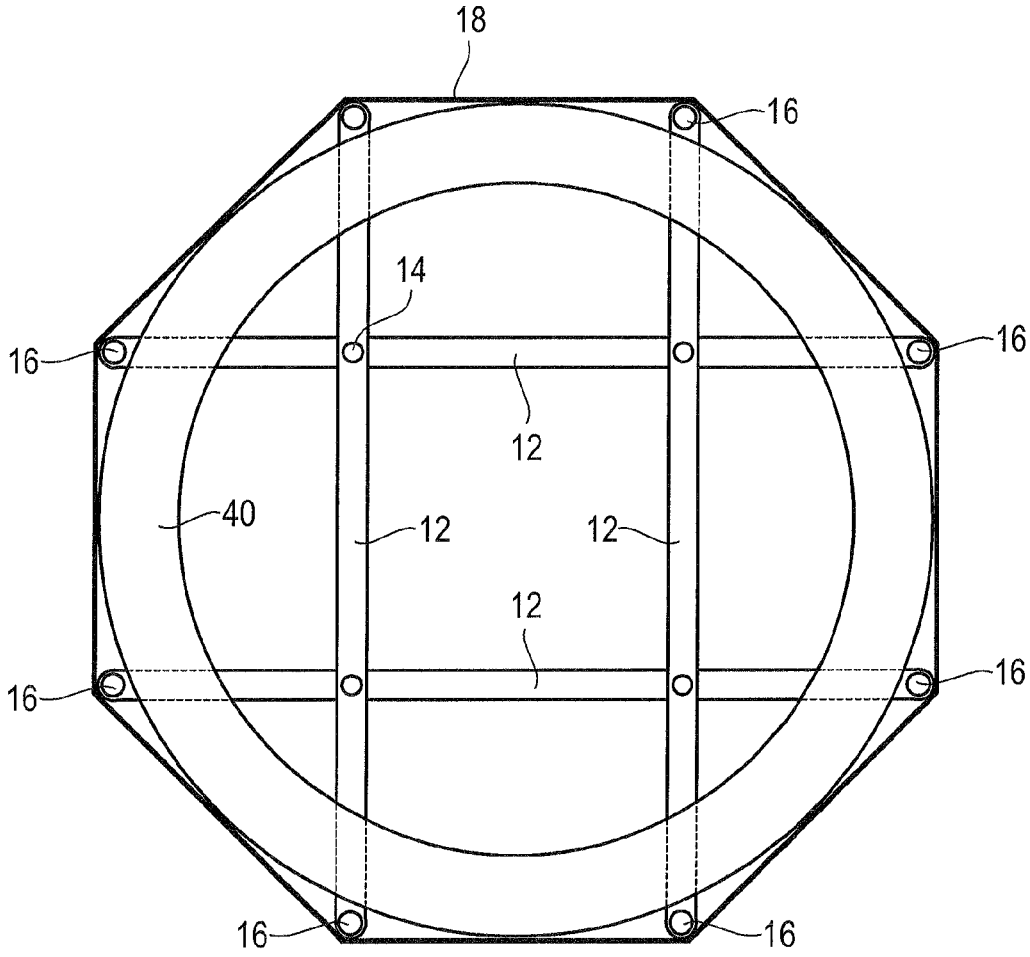

The metal cage 10 consists of a floor portion formed by four metal bars 12 arranged so as to form a grid (please see in particular FIG. 2). The metal bars 12 are arranged such that their outer ends define the corners of an octagonal. At each junction of two metal bars 12, they are preferably welded to each other. Further, a bolt hole 14 is provided at each junction, which extends through both superimposed metal bars.

Metal cage 10 further comprises a side portion or side structure formed from eight metal tubes 16. The metal tubes 16 are connected with one of their ends to a respective end of metal bars 12 so that they extend perpendicularly therefrom upwardly.

Figure 3:
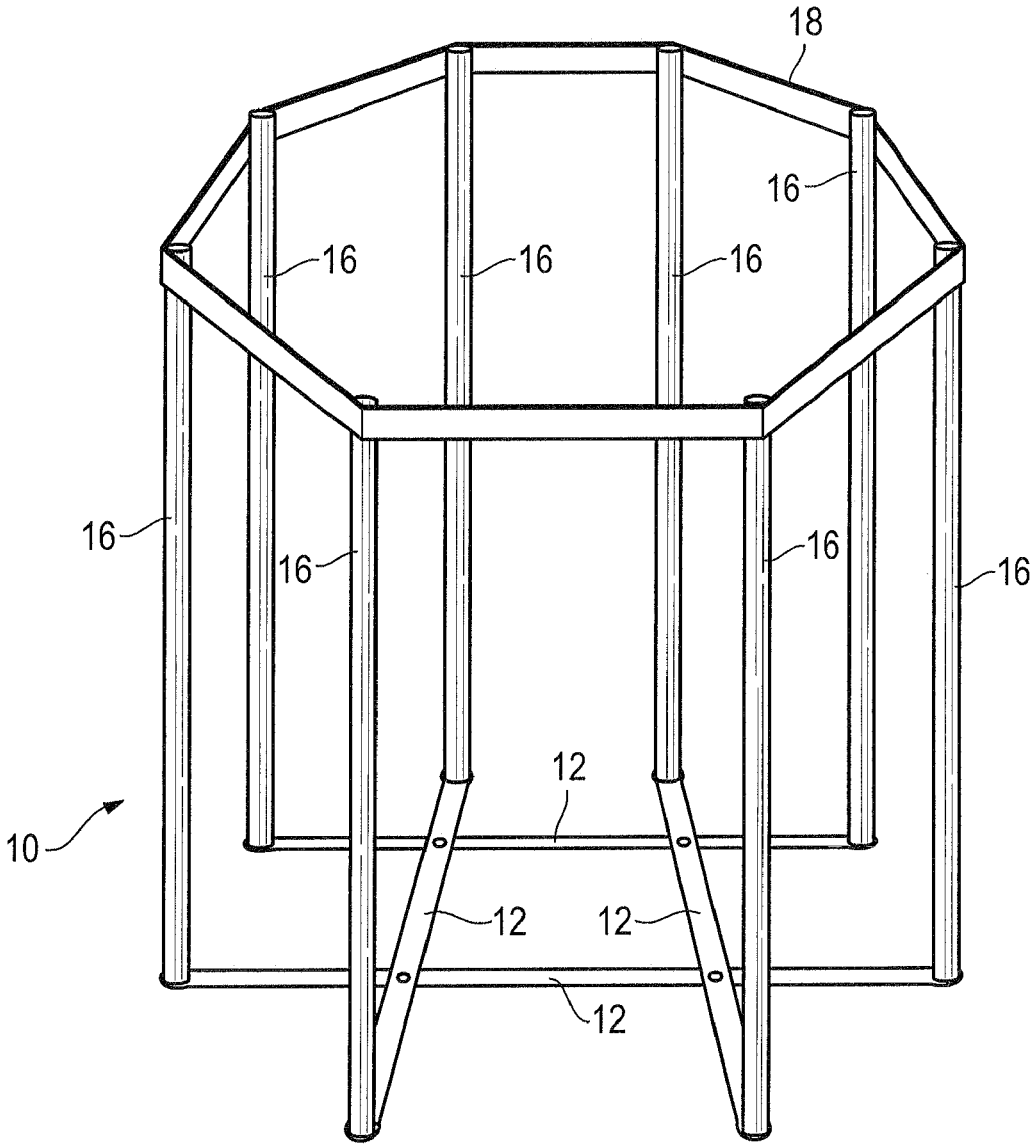
FIG. 3 shows the metal cage in a perspective view, FIG. 4 schematically shows a container with welding wire coil and retainer in a top view, FIG. 5*a* schematically shows a container and a dome, FIG. 5*b* schematically shows a detail of the connection of the dome to the metal cage, FIG. 6*a* schematically shows a welding wire coil with a starting portion.
Figure 4:
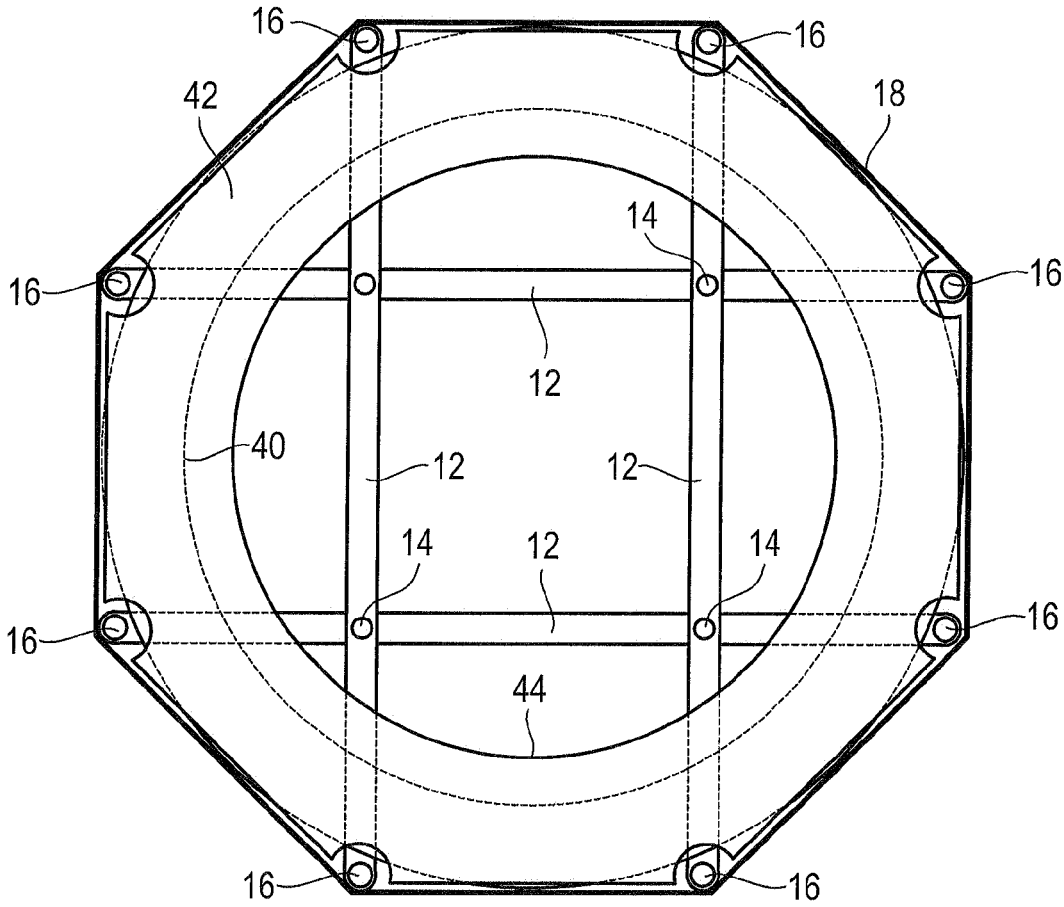

Finally, metal cage 10 comprises a reinforcement ring 18 which circumscribes the structure formed by the metal tubes 16 at their end which is opposite to the floor structure formed by metal bars 12. As can be seen in FIGS. 2 and 3, a metal frame is thereby formed which comprises a bottom formed by metal bars 12, a side structure formed by metal tubes 16 and an upper opening circumscribed by reinforcement ring 18. In a top view, the accommodation space within the metal cage has an octagonal cross section. All components can be welded to each other in order to combine reduced expenditure for manufacturing with high mechanical strength.

Cardboard cover 20 comprises of a cardboard wall 22 which covers the outer circumference of the side structure of the metal cage 10. Accordingly, cardboard wall 22 consists of eight segments each extending from one metal tube 16 to the adjacent one. Nevertheless, the entire cardboard wall 22 can be formed in a single, sleeve-like piece. Further, cardboard cover 20 comprises a cardboard floor 24 which is arranged underneath the floor portion of metal cage 10 and closes the underside of the container. Cardboard floor 24 is preferably provided separate from cardboard wall 22 and has a rim portion which outwardly circumscribes the lower edge of cardboard wall 22.

Figure 1:
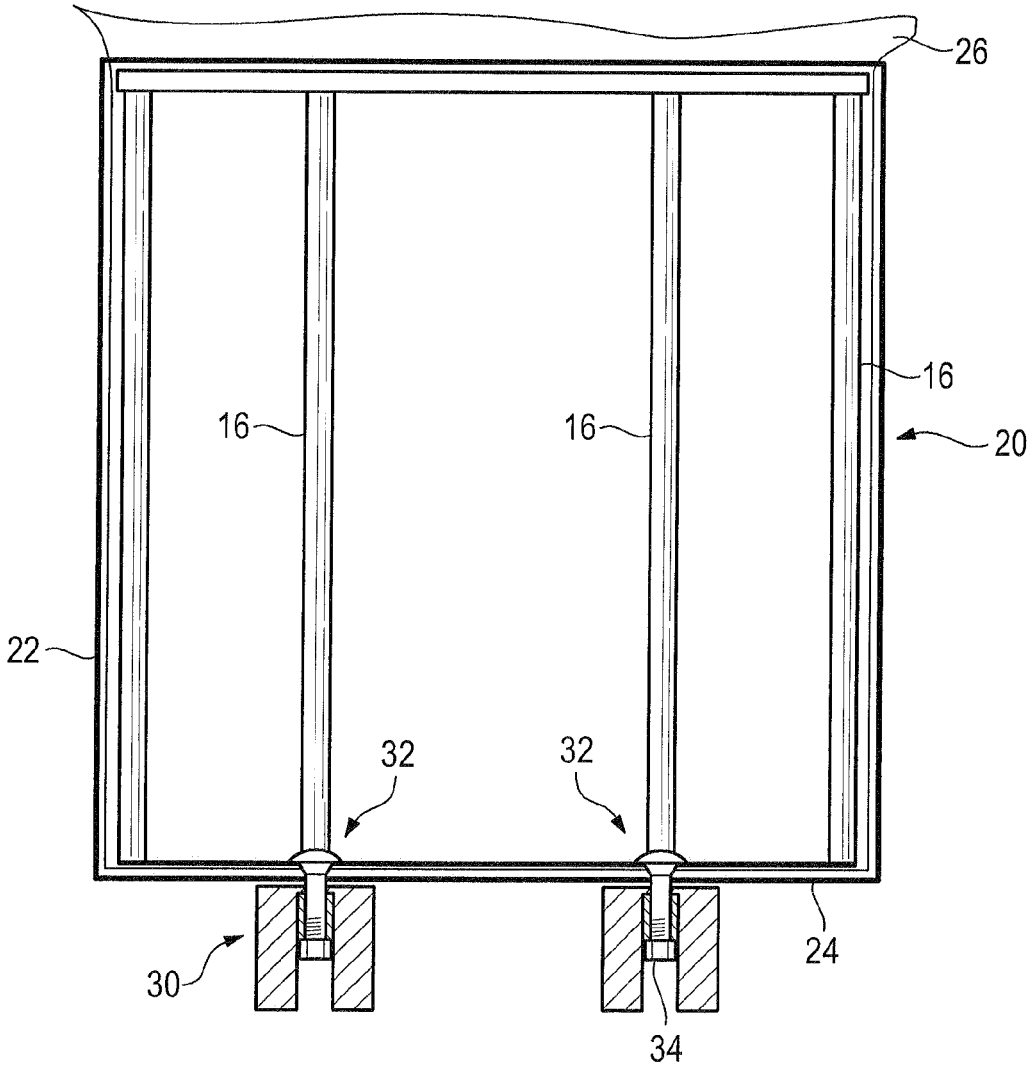

As can be seen in FIG. 1, a protective plastic bag 26 is provided which extends between metal cage 10 and the cardboard wall 22 and cardboard floor 24. Protective plastic bag 26 ensures that moisture cannot enter into the interior of the container. Cardboard wall 22 in combination with cardboard floor 24 provides a mechanical seal against dirt and contamination.

As can be seen in FIG. 1, wooden blocks 30 are provided which serve as supporting feet for the container. Wooden blocks 30 are connected to metal cage 10 by means of fastening bolts 32 which extends through bolt holes 14. The wooden blocks 30 are firmly attached to the metal cage by threading nuts 34 onto fastening bolts 32. The length of the fastening bolts is significantly shorter than the height of wooden blocks 30 so that nuts 34 are accommodated recessed within the wooden blocks. This ensures an electrical insulation between the metal cage and a floor on which the container is placed.

The wooden blocks can either be provided in the form of two long bars extending in parallel underneath the container, or in the form of four short sections. The first alternative provides more stability, but result in only two directions from which a forklift can be introduced. The second alternative results in a slightly reduced stability but allows introducing a forklift from four directions.

The container is intended to receive a large amount of welding wire 40 stored in the container in the form of a coil formed from a large number of welding wire loops. The coil formed from welding wire 40 is arranged such that it sits on the floor portion of the metal cage, namely on metal bars 12, and abuts with its outer circumferential surface at the eight metal tubes 16. The metal tubes 16, due to being connected to each other by means of metal bars 12 and reinforcement ring 18, can absorb the force which the individual welding wire loops exert on the metal cage in an radially outward direction. On top of the welding wire coil, a retainer 42 is preferably arranged. The retainer (please see in particular FIG. 4) has a generally octagonal shape, with recesses being provided in each corner so as to allow the metal tubes 16 to pass through. Retainer 42 is generally plate-like with an interior opening 44 which is circular and has a diameter which is slightly smaller than the inner diameter of the coil formed from welding wire 40. Retainer 42 prevents that welding wire loops prematurely lift from the welding wire coil.

Figure 5A:
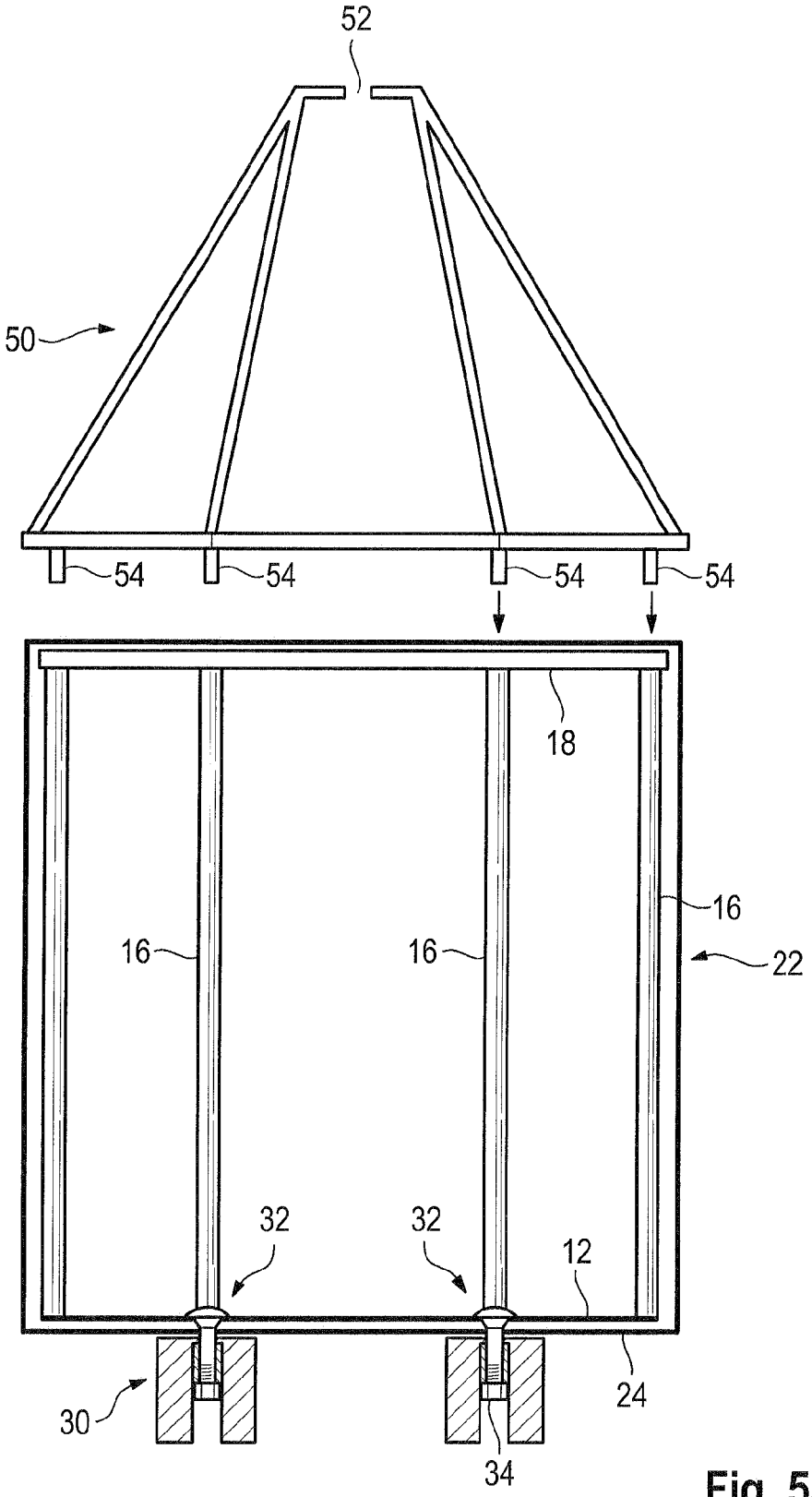
Figure 5B:
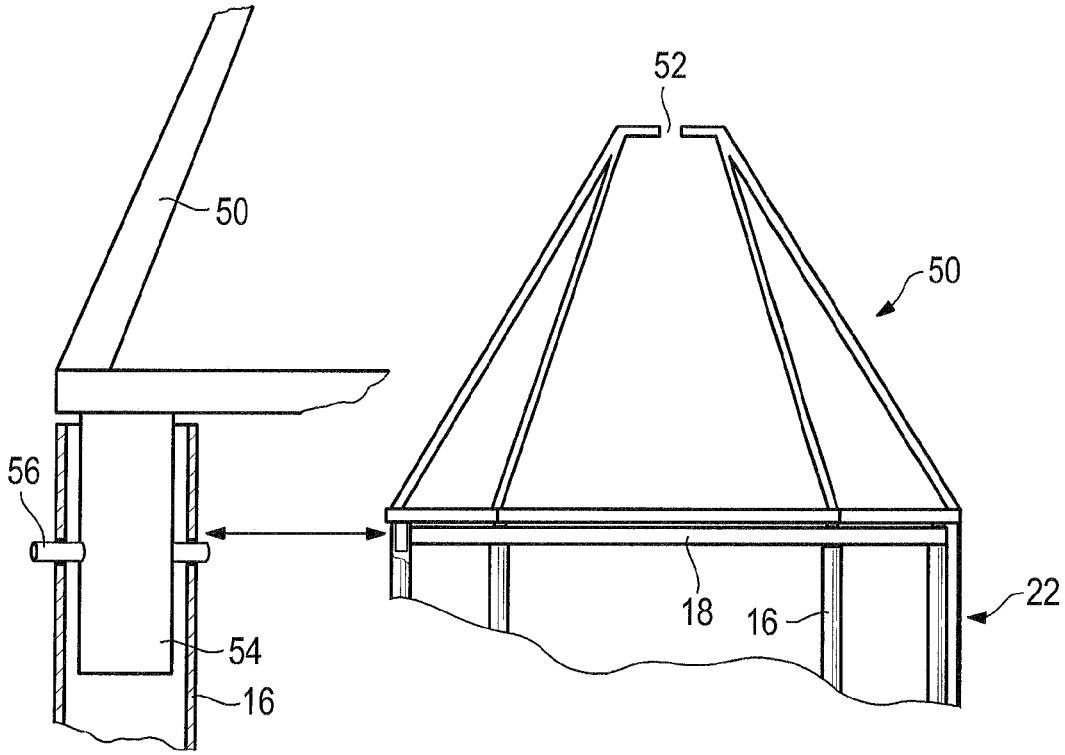

As can be seen in FIGS. 5*a* and 5*b*, a dome 50 can be used with the container, which has an upper opening 52 through which the welding wire can be withdrawn. Cage 50 is preferably a metal cage having a couple of legs 54 which are arranged and dimensioned so as to fit into the inner space of metal tubes 16 forming the corner reinforcements of the container. This allows to securely mount dome 50 to the container. If necessary, additional locking elements such as a pin 56 (please see FIG. 4) can be used which extends through a bore both in the metal tube 16 of the metal cage and the leg 54 of dome 50. This prevents that dome 50 unintentionally becomes separated from the container during use.

The container is particularly suitable for receiving welding wire with a comparatively large diameter, in particular significantly exceeding a diameter of 2.00 mm. The metal cage is of sufficient strength to receive and hold welding wire having a diameter of 4.00 mm and even 6.00 mm and above. This type of welding wire is particularly suitable for sub-arc welding.

Figure 6A:
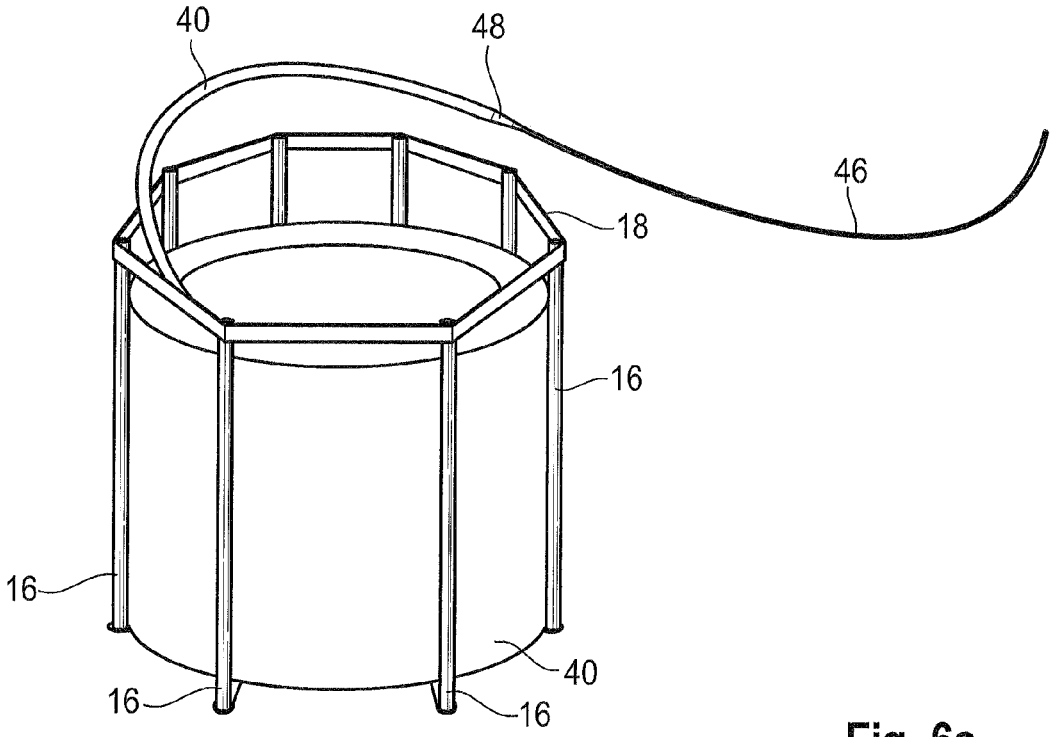
FIG. 6*b* shows a welding wire starting portion in a side view.
Figure 6B:
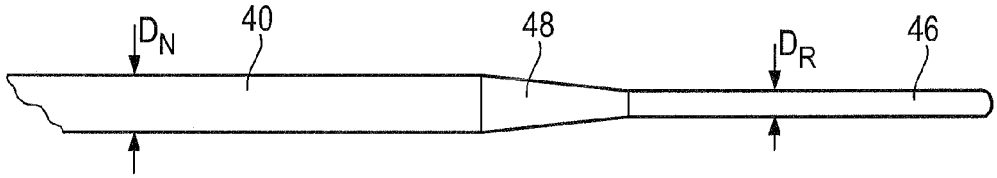

It has been experienced that welding wire with a diameter used for sub-arc welding cannot be easily inserted into sophisticated welding wire liners, in particular if these comprise a plurality of rolls and extend in curves having a small radius. Referring to FIG. 6*a* and FIG. 6*b*, in order to facilitate insertion of the welding wire into these liners, it is provided that the welding wire 40 of the coil has an initial insertion portion 46 whose diameter $D_R$ is reduced as compared to the nominal diameter $D_N$ of the remainder of the welding wire 40. This initial insertion portion 46 can have a diameter $D_R$ of for example 2.00 mm while the nominal diameter $D_N$ of the welding wire 40 is 4.00 or 6.00 mm. The insertion portion can be formed by gradually reducing the diameter in a transition portion 48 from the nominal diameter $D_N$ to the reduced diameter $D_R$, for example by using a drawing die, and to integrally form the insertion portion with the reduced diameter. As an alternative, the welding wire can be provided with the transition portion 48, and a separate portion of welding wire with smaller diameter $D_N$ can be butt-welded to the end of the transition portion 48 of the welding wire 40.

In any case, the insertion portion of the welding wire can be easily inserted into a liner so as to smoothly follow its curvatures when being pushed though the liner. As soon as the wire 40 with the nominal diameter $D_N$ has arrived at the welding torch, the initial insertion portion 46 can be cut off, and welding can start.

A particular advantage of the container is that it can be assembled and disassembled in a very simple manner. The cardboard cover 20 is held at the metal cage 10 by means of the supporting feet 30 which are mounted by a few bolts.

After the entire wire in a container has been consumed, a customer can dispose of the container in a convenient way. By unscrewing the nuts 34 from the bolts 32, the wooden blocks 30 can be separated from the container. This also results in the cardboard cover 20 becoming detached from the metal cage 10. Metal cage 10 can be sold as scrap metal. Cardboard wall 20 can be stored in a flat condition and finally recycled. The wooden blocks can be discarded. Accordingly, the customer does not have the problem what to do with an emptied container requiring much space.

The invention claimed is:

1. A container for accommodating an amount of welding wire, having a metal cage with a floor portion and a side portion extending from the floor portion, and having a cardboard wall associated to the side portion of the metal cage, wherein: (a) the floor portion is formed from four flat metal bars which are arranged pairwise perpendicular with respect to each other; (b) outer ends of the bars define eight corners of the container; (c) the side portion comprises metal tubes; and (d) a reinforcement ring is provided at an end of the side portion which is opposite the floor portion; and supporting feet, made from wood, are attached to the floor portion of the metal cage.

2. The container of claim 1 wherein the cardboard wall is formed in a single piece extending around the side portion of the metal cage.

3. The container of claim 1 wherein a cardboard floor is associated to the floor portion of the metal cage.

4. The container of claim 1 wherein the supporting feet are attached by bolts which extend from the interior of the container, and nuts which are accessible at an outer surface of the supporting feet.

5. The container of claim 1, further comprising a dome which is arranged at the end of the side portion of the metal cage which is opposite the floor portion.

6. The container of claim 5 wherein the dome is detachably connected to the metal cage.

7. The container of claim 1 wherein a protective plastic bag is arranged between the side portion of the metal cage and the cardboard wall.

8. The container of claim 1 in combination with a welding wire coil sitting on the floor portion of the metal cage and laterally resting at the side structure of the metal cage.

9. The container of claim 8 wherein the welding wire coil comprises welding wire having a diameter of more than 2.00 mm.

10. The container of claim 9 wherein the welding wire coil has a starting portion, the starting portion having a diameter which is reduced as compared to the diameter of the remainder of the welding wire of the welding wire coil.

11. The container of claim 10 wherein the starting portion has a length of 0.5 to 4 m.

12. The container of claim 10 wherein the starting portion has a diameter of approximately 2.00 mm.

13. A container for accommodating a welding wire coil, having a metal frame which defines an accommodation space for the welding wire coil, the metal frame having a bottom portion on which the welding wire coil is to be placed, and a side structure intended to laterally support the welding wire coil, the bottom portion of the metal frame being formed from four metal bars arranged so as to form a grid, the side structure of the metal frame being formed by eight metal tubes, each of which is connected to one of the ends of the metal bars, further having a cardboard wall structure covering the outside of the side structure of the metal frame and having an octagonal shape in cross-section, and a cardboard floor structure covering the outside of the bottom portion of the metal frame, and having supporting feet which are bolted to the metal frame and which clamp the cardboard floor structure to the bottom portion of the metal frame.

14. The container of claim 9, wherein the welding wire has a diameter of 4.00 to 6.00 mm.

15. The container for accommodating an amount of welding wire, having a metal cage with a floor portion and a side portion extending from the floor portion, and having a cardboard wall associated to the side portion of the metal cage, in combination with a welding wire coil sitting on the floor portion of the metal cage and laterally resting at the side structure of the metal cage, wherein the welding wire coil comprises welding wire having a diameter of more than 2.00 mm, and wherein the welding wire coil has a starting portion, the starting portion having a diameter which is reduced as compared to the diameter of the remainder of the welding wire of the welding wire coil.

16. The container of claim 15, wherein the starting portion has a length of 0.5 to 4 m.

17. The container of claim 15, wherein the starting portion has a diameter of approximately 2.00 mm.

18. The container of claim 15, wherein the welding wire has a diameter of 4.00 to 6.00 mm.

* * * * *